US011939850B2

(12) United States Patent
Larbi Zeghlache et al.

(10) Patent No.: US 11,939,850 B2
(45) Date of Patent: Mar. 26, 2024

(54) APPARATUS FOR TCA BLEED OFF AND WELL START-UP

(71) Applicant: SAUDI ARABIAN OIL COMPANY, Dhahran (SA)

(72) Inventors: Mohamed Larbi Zeghlache, Al Khobar (SA); Salem H. Suwadi, Khurais (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 93 days.

(21) Appl. No.: 17/647,394

(22) Filed: Jan. 7, 2022

(65) Prior Publication Data

US 2023/0220753 A1 Jul. 13, 2023

(51) Int. Cl.

| | |
|---|---|
| ***E21B 43/16*** | (2006.01) |
| ***E21B 33/06*** | (2006.01) |
| ***E21B 33/068*** | (2006.01) |
| ***E21B 43/12*** | (2006.01) |

(Continued)

(52) U.S. Cl.

CPC ..... *E21B 43/168* (2013.01); *E21B 33/068* (2013.01); *E21B 43/123* (2013.01); *E21B 49/008* (2013.01); *E21B 49/088* (2013.01)

(58) Field of Classification Search

None

See application file for complete search history.

(56) References Cited

U.S. PATENT DOCUMENTS

| | | | |
|---|---|---|---|
| 4,756,371 | A | 7/1988 | Brieger |
| 4,793,417 | A | 12/1988 | Rumbaugh |
| 4,945,992 | A | 8/1990 | Sacco |

(Continued)

FOREIGN PATENT DOCUMENTS

| | | | |
|---|---|---|---|
| CN | 103410474 | B | 10/2015 |
| CN | 112963123 | A | 6/2021 |

(Continued)

OTHER PUBLICATIONS

Alquwizani, Saud A., et al., "Managing Tubing-Casing-Annulus in ESP Completions for Enhanced Wellbore Integrity and Improved ESP Runlife", SPE-173702-MS, Society of Petroleum Engineers, Nov. 2014, pp. 1-11 (11 pages).

*Primary Examiner* — Charles R Nold

(74) *Attorney, Agent, or Firm* — Osha Bergman Watanabe & Burton LLP

(57) ABSTRACT

A treatment system comprises a treatment bladder associated with a volume of a tubing-casing annulus of a wellhead system to be treated. The treatment bladder contains a treatment fluid and is at an elevated pressure. The treatment bladder is coupled to the tubing-casing annulus utilizing a fluid conduit through a lower fluid junction. The fluid conduit permits two-way fluid communication between the treatment bladder and the tubing-casing annulus. A method for treating the tubing-casing annulus includes coupling the treatment bladder containing the treatment fluid of the treatment system to the tubing-casing annulus of the wellhead system using the fluid conduit, establishing two-way fluid communication between the tubing-casing annulus and the treatment bladder though the fluid conduit, halting fluid communication though the fluid conduit, and decoupling the treatment bladder from the tubing-casing annulus.

20 Claims, 4 Drawing Sheets

(51) Int. Cl.
*E21B 49/00* (2006.01)
*E21B 49/08* (2006.01)

(56) References Cited

U.S. PATENT DOCUMENTS

| | | | | |
|---|---|---|---|---|
| 5,458,198 | A | 10/1995 | Hashemi et al. | |
| 6,929,068 | B2 | 8/2005 | Chitty | |
| 6,982,008 | B2 * | 1/2006 | Walker | E21B 37/00 175/215 |
| 8,684,089 | B2 | 4/2014 | Borhaug et al. | |
| 10,161,224 | B2 | 12/2018 | Wilson | |
| 2008/0142226 | A1 * | 6/2008 | Wilson | E21B 37/06 166/177.5 |
| 2009/0050326 | A1 | 2/2009 | Grynning | |
| 2021/0172290 | A1 | 6/2021 | Holcomb | |
| 2022/0010641 | A1 * | 1/2022 | Haugland | E21B 27/00 |

FOREIGN PATENT DOCUMENTS

| | | | |
|---|---|---|---|
| CN | 112983325 | A | 6/2021 |
| DE | 19932593 | C1 | 5/2001 |
| RU | 2416024 | C1 | 4/2011 |
| RU | 2728015 | C1 | 7/2020 |

* cited by examiner

APPARATUS FOR TCA BLEED OFF AND WELL START-UP

BACKGROUND

Traditionally, near the end of completions operations and close to the time of initiating production, a wellbore that has effluent contained in-between a production tubing and a production casing—the tubing-casing annulus (TCA)—is cleaned using a well-appreciated procedure. This procedure involves the introduction of a fluid, usually an inhibited water, into the tubing-casing annulus, at an elevated pressure from the pressure in the TCA. After introducing the inhibited water at pressure, a period of monitoring and maintenance occurs—usually about 30 minutes. Finally, the TCA is depressurized such that an effluent is generated from the TCA. The depressurization of the TCA often results in a mixture of inhibited water, completion fluid, annular fluid, and potential contaminants coming out. "Contaminants" in this case refers to hydrocarbon fluids—both gases and liquids at atmospheric conditions. This operation is repeated until the effluent that comes out during the depressurization is a clean inhibited water. At that point then production on-lining activities may continue.

SUMMARY

In one or more aspects, a treatment system comprises a treatment bladder. The treatment bladder has a volume that is in a range of 80 to 120% of the volume of a tubing-casing annulus of a wellhead system to be treated. The treatment bladder contains a treatment fluid having a pressure in a range of from about 90% to 110 o the pressure of the tubing-casing annulus. The treatment bladder also comprises a lower fluid junction. The treatment system also comprises a fluid conduit. The fluid conduit is coupled to both the treatment bladder at the lower fluid junction and a tubing-casing annulus junction for a tubing-casing annulus of a wellhead system. While coupled, the fluid conduit is configured to convey a fluid having a density less than the treatment fluid to traverse from the tubing-casing annulus to the treatment bladder and a fluid having a density equal to or greater than the treatment fluid to traverse from the treatment bladder tank to the tubing-casing annulus simultaneously and without any active mechanical assistance when selective fluid connectivity is established. The fluid conduit is rated to withstand both a pressure of at least a maximum allowable annular surface pressure (MAASP) of the tubing-casing annulus and a temperature of at least a maximum production fluid temperature.

In one or more aspects, a method for treating a tubing-casing annulus may also include coupling the treatment bladder containing the treatment fluid of the treatment system of to the tubing-casing annulus of the wellhead system using the fluid conduit. The lower fluid junction of the treatment bladder is positioned at an elevation higher than the tubing-casing annulus junction of the tubing-casing annulus of the wellhead system. The method may also include establishing two-way fluid communication between the tubing-casing annulus using the tubing-casing annulus junction of the wellhead system and the treatment bladder though the fluid conduit. The method may also include halting fluid communication though the fluid conduit between the tubing-casing annulus and the treatment bladder. The method may also include decoupling the treatment bladder from the tubing-casing annulus.

Other aspects of the disclosure will be apparent from the following description and the appended claims.

BRIEF DESCRIPTION OF DRAWINGS

Other aspects and advantages of this disclosure will be apparent from the following description made with reference to the accompanying drawings and the appended claims.

Figure 1A:
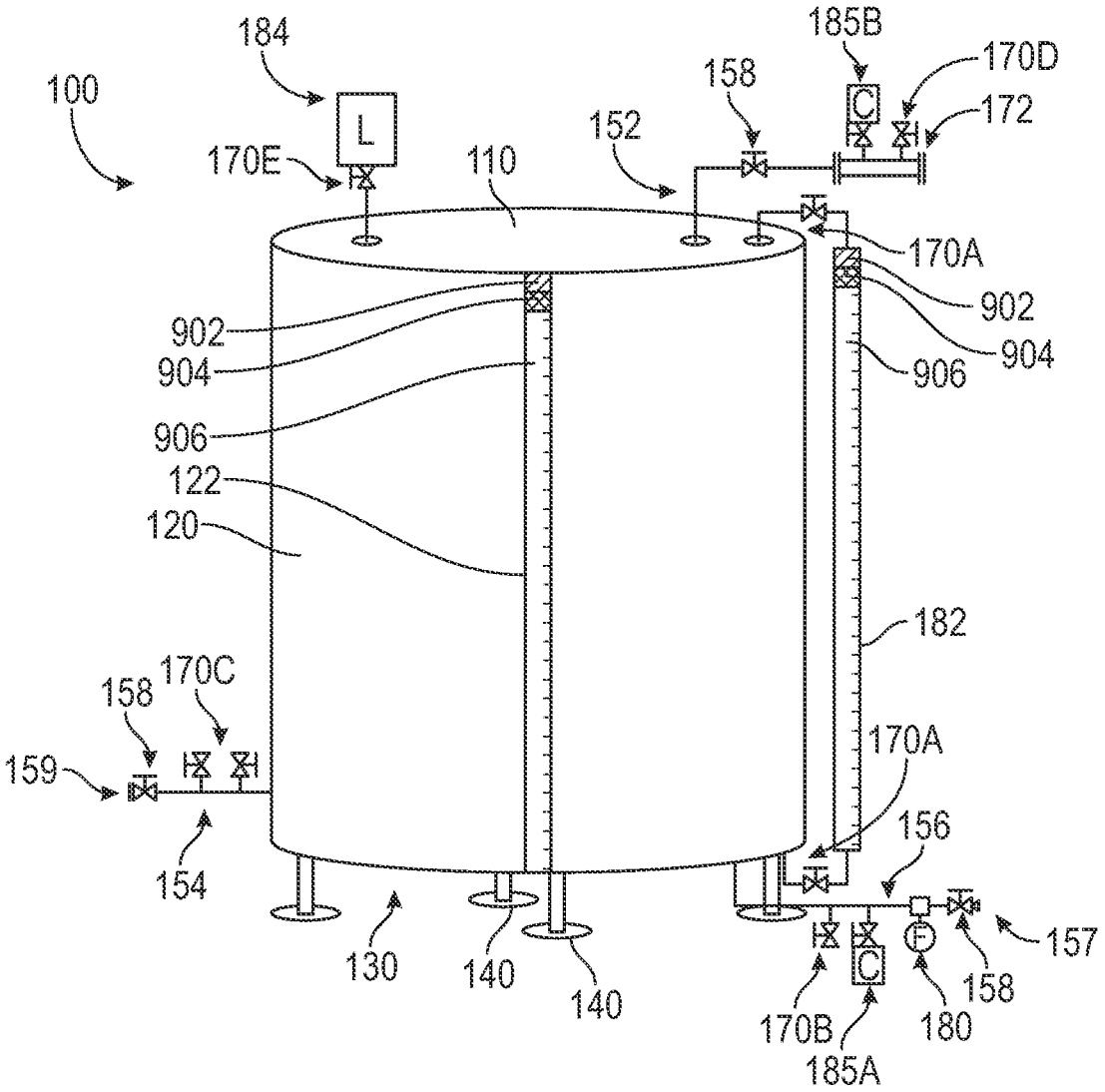
FIG. 1A shows a view of an inhibited water bladder according to one or more embodiments.

In describing the comparative position of one object over another and both are associated with the treatment bladder, the terms "uptank" and "downtank", may be used comparatively. In using the term "uptank", this means that the object is coupled or connected closer to the treatment bladder than the other object; "downtank" means that the object is coupled or connected farther from the treatment bladder than the other object. Such comparative language is similar in context with relative position terms like "upstream" and "downstream", which a person of skill in the art should be familiar.

DETAILED DESCRIPTION

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

The tubing-casing annulus (TCA) may have contaminants with the completion fluid for a variety of reasons. The TCA may be a small, fluid-filled annular volume near the top of the wellhead. The TCA is defined by the outer surface of the production tubing, the inner surface of the production casing, the wellhead seals, and a production isolation packer lower down the wellbore, such as an electrical submersible pumps (ESP) upper packer, if an ESP is present.

Before hydrocarbon production is initiated for the first time (completion operations are finished), the completion fluid in the TCA might also include an amount of contaminants as previously described. The contaminants might have migrated to the upper portion of the wellbore near the wellhead as drilling and completion fluids moved around. The contaminants in the TCA must be removed before hydrocarbon production starts. The reason why is that the fluids in the TCA have not been previously exposed to prolonged periods of reservoir-temperature fluids. When the fluids in the TCA are first exposed to the production fluid, the previously cool, fluid-filled annulus is suddenly heated by reservoir-temperature fluids flowing through the production tubing. Because the TCA is a fixed volume, the increase in temperature causes a rise in pressure in the TCA. The internal pressure increase may damage the production tubing, the production casing, the seals on the wellhead, or the production packer.

The pressure problem against cool metal and elastic seals may be exacerbated if the production is ESP-supported. The sudden uprush of reservoir-temperature fluid through the production tubing may create a large heat flux into the TCA while the rest of the equipment in the wellhead and upper wellbore are still relatively cool. This situation may create a thermal shock that causes seals to separate or warping of metal, forming long-term leaks into and out of the TCA, where more contaminants may accumulate. This problem may also occur in naturally-flowing wells, but being able to simply "turn on" hydrocarbon production to full production tubing volume with an ESP makes the problem more likely to occur in ESP-supported wellbores.

If it is determined that there is a pressure problem in the TCA, usually the solution is to bleed off the pressure in the TCA while production is occurring to a level that is elevated but not too much greater compared to the pressure in the production tubing. However, sometimes human error may cause additional problems during TCA bleed off. If the pressure is bled off too quickly, the opposite problem may occur: explosive decompression. Once the TCA is heated, all of the metal and non-metals, including any equipment in and traversing the TCA, thermally expand. The elevated temperatures may also create elevated internal pressures within such equipment. Relieving the pressure within the TCA at a time when the equipment is heated by production fluid flowing may cause a pressure differential between the interior and exterior of the thermally-heated equipment that the equipment cannot tolerate. If the pressure differential is too great, the equipment may explosively decompress, allowing annular fluid to infiltrate the rupture in the equipment. As completion fluid is often water-based, water infiltration may cause failure—either instant or a greatly shortened operable lifespan—of the now-ruptured equipment.

In addition to the risks of equipment failure if contaminants are not removed from the tubing-casing annulus before production starts, the traditional method for removing contaminants from a TCA takes a long time to perform and exposes workers unnecessarily to the wellhead during a potentially hazardous period (before and during production startup). To remove contaminants from a TCA, usually several pressurization and depressurization cycles of the TCA using a completion fluid, such as inhibited water, must occur. In between each round of pressurization and depressurization, at least a 30-minute pause is provided. A 30-minute pause is provided to permit the fluid in the TCA, which has been turbulently mixed when the completion fluid was introduced, to settle. During this settling period, the contaminants are supposed to rise again to the top of the TCA such that upon depressurization they are removed. However, this process is rarely successful with one cycle because each time the pressurized fluid is introduced, the contaminants are turbulently dispersed throughout the TCA. This process is repeated until the effluent coming out of the TCA during the depressurization of the TCA is completely clear. This process, therefore, may be repeated anywhere from two to ten times before the effluent is clear. The entire process may take from one to several days, especially for a heavily contaminated annulus, to be completely purged. As well, the traditional process is wasteful regarding materials because large amounts of inhibited water are utilized to pressurize and purge the annulus. Each time, the inhibited water is disposed of to prevent reintroduction of contaminants.

A better solution that reduces potential damage to wellbore equipment, increases the safety margin for personnel, is faster to complete, and is less wasteful of valuable water resources is desired.

A useful system for treating a tubing-casing annulus may include a tank or bladder (hereinafter treatment tank or bladder) filled with a treatment solution. In some instances the treatment solution is an inhibited water; in others, it is an inert gas, such as nitrogen. The volume of the treatment bladder is approximately the volume of the tubing-casing annulus to be treated. The pressure maintained on the treatment fluid in the treatment bladder is slightly below or approximately the pressure of the tubing-casing annulus to be treated. The treatment bladder is coupled to and elevated above the TCA to exploit the differences in relative buoyancy of the fluids. Upon initiating fluid communication between the bladder and the TCA, gravity and buoyancy-driven fluid flow may occur. The contaminants, being generally less dense that the treatment fluid, gently and consistently flow into the fluid coupling and upwards towards the treatment bladder. By having the treatment bladder and TCA at a similar pressure, if any initial inflow of treatment fluid into the TCA occurs, the disruption does not violently disturb the contaminants accumulated near the top of the TCA. Rather, the treatment fluid entering the TCA gently drives out and exchanges places with the lighter fluids. As contaminants flow into the treatment bladder, and the types and amounts of effluent entering the bladder may be monitored using sensors, visually by personnel, including utilizing a pressure gauge and a visual inspection window, or both. The pressure of the treatment bladder should be in equilibrium with the TCA once in fluid communication, so any influx into the TCA would also result in a pressure increase in the treatment bladder. When contaminants stop entering the treatment bladder, the process of TCA cleanout is complete.

Advantageously, embodiments of the present disclosure do not require the repeated pressurization and depressurization of the TCA annulus to discharge annular effluent and contaminants as is done with current cleanout procedures. This may save a significant amount of time—hours if not potentially days. There is also no "30-minute wait period" either. The fluid flow between the treatment bladder and the TCA starts upon establishing fluid communication and continues until all of the less-dense contaminant fluid flows into the treatment bladder. In addition, the annulus may be maintained at the production startup pressure without having to readjust its pressure after exchange of contaminants for treatment fluid.

Monitoring of the system during the procedure may take place well away from the wellhead by direct visual or sensory observation of the treatment bladder. There is no direct "fluid driver" or pump needed to push completion fluid or inhibited water into the annulus, preventing potential human error in accidental over pressurization of the TCA, which may cause seals to rupture and equipment damage. The process therefore increases safety of personnel working near the wellhead because there is less hands-on contact or directly monitoring conditions at the wellhead itself, which is sometimes needed utilizing traditional contamination evacuation procedure.

Less equipment is also required utilizing the described system and method. Along with not needing a pump to pressurize the TCA, there is also no need for a "bleed tank" to purge the large volume of the aforementioned TCA effluent discharged received during the TCA cleanout. The treatment bladder providing the treatment fluid receives and contains all the contaminants until it is desired to purge the treatment bladder of the contaminants.

The process is also efficient in its use of water. The technique utilized results in that every drop of treatment fluid entering the TCA replaces an equal volume of contaminant fluid leaving the TCA—100% of the contaminants are replaced with treatment fluid.

Another part of the solution is to bring a producing wellhead online. As part of the method, the treatment bladder may maintain fluid communication with the tubing-casing annulus either before or after the contaminants are removed. No additional steps are required to modify the system while hydrocarbon production is initiated. In such a process, hydrocarbon production is initiated through a production tubing already in place. The hot wellbore and reservoir fluids entering the production tubing and passing to the surface transfers a significant amount of heat into the TCA, whether this is by natural flow-based production or through pump-supported production, such as an electrical submersible pump (ESP) or similar system. As the annular fluid in the TCA heats up, the annular fluid naturally wants to expand; however, in the confines of a TCA there is no additional volume capacity, causing the pressure of the heated annual fluid to significantly increase. In some instances, especially in the case where forced fluid production is being utilized due to the volume of heated production fluid, this may result in a pressure in excess of the maximum allowable annular surface pressure (MAASP).

The methods and systems provided; however, establish or maintain the TCA in fluid communication with the treatment bladder. In such embodiments, the annular fluid is able to safely expand through the conduit through which both the TCA and the treatment bladder are in fluid communication. The treatment bladder effectively acts as a fluid surge tank for the expanding heated annular fluid. Utilizing the system and the process, the final pressure of the TCA may then be regulated through the treatment bladder: an increase or decrease in the treatment bladder pressure using a fluid pump or pressurized gas may be communicated through to the TCA via the fluid coupling.

Once again, for safety purposes, any bleed down in pressure of the TCA, if needed, may be handled at the treatment bladder, which is positioned well away from the wellhead undergoing initial fluid production. After the wellhead temperature and pressures have stabilized and production established at a stable level, the fluid communication between the TCA and the treatment bladder may be selectively terminated, the fluid conduit line cleared, and the treatment bladder removed from the area. Any recovered additional contamination or excess annular fluid may be retained by the treatment bladder and disposed of using a purge tank, may be pumped to the production line through a dedicated coupling between the treatment bladder and the production line, or may be maintained in the treatment bladder and transported back for later cleaning and disposal, including for research purposes.

In addition to the benefits already described or implied, variants of the treatment bladder, the system, and its method of use may provide for minimal human intervention, that is, may aspects of the system and process occur passively. As well, many of the steps not requiring direct human intervention, such as the coupling and decoupling of fluid conduits, may be automated through the pre-determined instructions provided for by a computer processor in response to received data signals. The treatment bladder provides an additional pressurized fluid safety barrier and environmental control by preventing hydrocarbons from entering the atmosphere directly, such as by not utilizing traditional TCA bleed down techniques. When utilized during either contamination removal or production startup, the treatment bladder may assist in detecting leaking into or out of the TCA by changes in its own parameters while in fluid communication.

FIG. 1A shows a view of an inhibited water bladder according to one or more embodiments. The volume of the interior of treatment tank, vessel, or bladder 100 ("treatment bladder") is defined by a top 110, at least one side wall 120, and a bottom 130 as shown in FIG. 1. A portion of the sidewall 120 provides an optical window 122 (also known as a visual inspection window) such that the interior contents of the treatment bladder 100 may be monitored. Supports 140 are coupled (not shown) to the bottom 130 and elevate the bottom 130 of the treatment bladder 100. Three exterior fluid couplings extend from the treatment bladder 100: a purge/vent fluid coupling 152 coupled to the top 110; an IW ("inhibited water") fluid coupling 154 coupled to the side wall 120 proximate to the bottom 130; and a tubing-casing annulus (TCA) fluid coupling 156 coupled to the bottom 130 of the treatment bladder 100. Associated with each exterior coupling is an isolation valve 158 downtank from the treatment bladder 100. Associated with each exterior coupling is a sensor port 170, where one or more sensors may be attached. The TCA fluid coupling 156 is shown with an optional in-line flow meter 180 such that flow may be detected or determined in the TCA fluid coupling 156, depending on the configuration of the flow meter. treatment bladder 100 is also shown with an optional sight glass 182 (also a visual inspection window) coupled to the top 110 and bottom 130 such that the fluid level within the treatment bladder 100 may be visually observed.

The treatment bladder may take any number of external 3-dimentional (3D) configurations, including, but not limited to, spheroid, cylindrical (for example, treatment bladder 100), cubic, and cuboid. If the treatment bladder is configured as a spheroid, then the surface of the spheroid is the sidewall, where the sidewall acts as the top, sidewall, and bottom for descriptive purposes.

The treatment bladder is configured such that it has a volume that is sufficient to contain an amount of treatment within a range of the volume of the tubing-casing annulus being treated. Before and possibly during and after treatment, the treatment bladder may contain a treatment fluid comprising inhibited water to exchange with the annular fluid present in the TCA. In one or more embodiments, the volume of the treatment bladder is in a range of from about 80 to 120% of the volume of the TCA to be treated. For example, the volume of the treatment bladder may be in a range of from about 0.5 bbls (U.S. barrels) to 100 bbls, such as 1, 2, 10, 15, and 100 bbls in fluid volume.

The volume of the tubing-casing annulus to be treated may be determined as the volume in-between the production tubing and the production casing, above a completion packer, and below the casing hangar. If the completion packer is not present, there is no pressure in need to depressurize.

The treatment bladder is configured to withstand prolonged exposure to a treatment fluid comprising an inhibited water comprising a corrosion inhibitor, an pressurized inert gas, or a combination of both; inert, acid, and sour gases; gaseous and liquid hydrocarbons; and drilling and completion fluids. Many of these fluids may be in small quantities and come from recovered contaminants from the TCA treatment; however, they may be retained in the treatment bladder for prolonged periods. If the treatment bladder is transported from one site to another, then turbulent mixing may occur, and the non-inhibited water and non-inert gases may be distributed throughout the interior of the treatment bladder as a multi-phase fluid. The material of construction may be a metal, such as carbon steel or alloys of steel, or a non-metallic material, such as a polymer, for example, fiberglass, high-density polyethylene (HDPE), glass reinforced epoxy (GRE), or reinforced thermo-plastic (RTP). Any material that can handle the potential temperature and pressure of completion fluid, hydrocarbon gases, or light hydrocarbon liquids at production temperatures of hydrocarbon reaching the surface through a production tubing (should there be excessive fluid expansion of the fluid in the tubing-casing annulus or a leak in the TCA). Considerations for material selection should also include for potentially corrosive materials. Corrosive materials may include water from the formation, such as formation brines; drilling fluids, such as saline drilling fluids; and certain completions fluids. In addition, acid gases from the wellbore, such as carbon dioxide and hydrogen sulfide, may aggravate the corrosion process.

In one or more embodiments, the treatment bladder is configured such that the sidewall is transparent. For example, the treatment bladder may be fabricated from a transparent or mostly translucent material, such as a polyacrylic material. The thickness of the material will be dependent upon the ultimately pressure rating of the treatment bladder, but it is envisioned that it may be a few millimeters to several inches in thickness depending on the utilization.

The treatment bladder is configured such that it has a pressure rating that is sufficient to operate with the tubing-casing annulus during either a cleanout procedure, a startup procedure, or a combination of both. The maximum pressure of the treatment bladder should be at least the maximum allowable annular surface pressure (MAASP) of the tubing-casing annulus being treated, that is, the MAASP value of the TCA should not exceed the maximum operating pressure of the treatment bladder. In one or more embodiments, the treatment bladder has an operating pressure in a range of from about atmospheric pressure to 20,000 pounds-per-square inch (psi), such as from about atmospheric to 3,000 psi. In one or more embodiments, the treatment bladder may be equipped with pressure-relief valves to protect the integrity of the treatment bladder should an over-pressurization event occur.

Figure 1B:
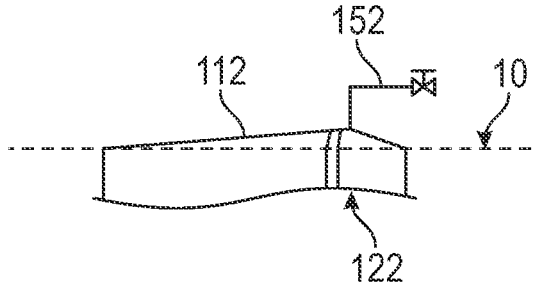
FIG. 1B shows an optional configuration where the top of the treatment bladder is sloped according to one or more embodiments.

FIG. 1B shows an optional configuration where the top of the treatment bladder is sloped upwards (sloped top 112) towards the purge/vent coupling 152 and is not flat or horizontal (dashed line 10). Such a configuration may be useful where sensors are coupled to the purge/vent coupling 152 that may detect gases, including hydrocarbon gases, non-inhibited water fluids, such as hydrocarbon fluids, lighter-than-water emulsions, or simply changes to the composition (for example, salinity, density) of the treatment fluid within treatment bladder 100.

Figure 1C:
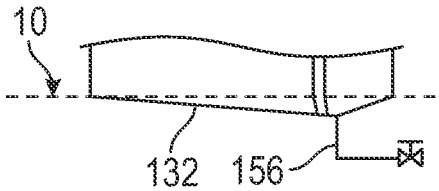
FIG. 1C shows an optional configuration where the bottom of the treatment bladder is sloped according to one or more embodiments.

FIG. 1C shows an optional configuration where the bottom of the treatment bladder is sloped downwards (sloped bottom 132) towards the purge/vent coupling 152 and is not flat or horizontal (dashed line 10). Such a configuration may be useful there is a requirement to absolutely drain or purge all material out of the treatment bladder 100 through TCA coupling 156, including any entrained hydrocarbons or emulsions. Such a sloped bottom 132 permits gravity to assist in draining treatment bladder 100 of all fluids.

As described with FIG. 1A, treatment bladder 100 is shown with an optional portion of its sidewall 120 being an optical window 122 (that is, a visual inspection window). In one or more embodiments, a portion of the sidewall is configured as an optical window. In one or more embodiments, the optical window is transparent. The optical window is configured such that the lowest portion and the highest portion of the treatment bladder are externally visually observable.

In instances where the treatment bladder is configured with a sloped top, a portion of the optional optical window may extend onto the sloped top. For example, in FIG. 1B optical window is seen extending towards purge/vent coupling 152. In instances where the treatment bladder is configured with a sloped bottom, a portion of the optional optical window may extend onto the sloped bottom. In such cases, this may permit observation of the highest portion or the lowest portion of the treatment bladder, respectively.

The optical window portion of a sidewall may be configured to permit visual observation from outside of the treatment bladder to confirm fluid level within the treatment bladder without requiring other sensor-based confirmation, such as a level detector. The optical window is configured to permit observation from outside of the treatment bladder to confirm the presence of different fluid phases, such as the presence of aqueous and non-aqueous phases, or the presence of liquid and vapor phases. For example, in FIG. 1A treatment bladder 100 is shown with a minor amount of gases 902 and liquid hydrocarbons 904 floating on top of a significant amount of treatment fluid 906. An observation of the two liquid phases and the gas phase present in the treatment bladder 100 and their relative amounts are easy to discern—both for their quantities and their phases—utilizing the optical window 122. In making such an observation, especially during a period of treatment or afterwards, consideration may be made and actions taken based upon a visual observation of the fluids within the treatment bladder via the optical window. The optical window permits the visual inspection of potential contaminants in the treatment bladder and determine if a clean out of the treatment bladder is necessary. The optical window also is a safety feature, indicating if hydrocarbons are potentially present intermingled with the inhibited water. The optical window also allows for visual confirmation and quality control inspection of the inhibited water.

The treatment bladder may have a number of fluid couplings or connections that act as ports for conveying fluid in and out of the interior of the treatment bladder. For example, the treatment bladder 100 shows three fluid couplings: purge/vent fluid coupling 152, TCA fluid coupling 156, and IW fluid coupling 154.

An IW fluid coupling may be utilized to facilitate a fluid connection with a source of inhibited water, such as an IW tank, to supply inhibited water to the treatment bladder. The IW fluid coupling may be utilized to facilitate coupling with a pressure driver, such as a pump, to introduce IW fluid into the treatment bladder so as to maintain or increase the internal pressure of the treatment bladder. The IW pump coupling may be connected or coupled to the treatment bladder via the top, the sidewall, or the bottom.

The purge/vent fluid coupling acts as the highest fluid junction for the treatment bladder. A purge/vent fluid coupling may be utilized to facilitate fluid communication with a source of an inert fluid, such as a high-pressure nitrogen tank (HP N2), which may be used to introduce an inert gas to act as the treatment fluid or to maintain or increase the internal pressure of the treatment bladder. The purge/vent fluid coupling, being the highest point in the treatment bladder, may also act as the gas purge, such as to a purge tank for collecting gases accumulated in the upper portion of the treatment bladder. The purge/vent fluid coupling may also be utilized to ensure that the treatment bladder is completely liquid filled. The purge/vent fluid coupling may also be utilized for pressure relief of the vessel either during maintenance or during use, if necessary. The purge/vent fluid coupling may be connected or coupled to the treatment bladder via the top or the sidewall, but preferably in a manner such that the entirety of the volume of the treatment bladder is fluidly accessible. In instances where the top of the treatment bladder is sloped, the purge/vent fluid coupling maybe attached to the treatment bladder at the apex of the slope, such as shown in FIG. 1B.

The TCA fluid coupling acts as the lowest fluid junction for the treatment bladder. The TCA fluid coupling may facilitate fluid communication with a tubing-casing annulus (TCA) of a well system. The TCA fluid coupling may be utilized to facilitate fluid movement between the TCA and the treatment bladder such that less dense fluids, such as gases and most hydrocarbons, may traverse towards the treatment bladder and the treatment fluid, such as inhibited water or high-pressure nitrogen, which is denser than gases and most hydrocarbons, may traverse towards the TCA. The TCA fluid coupling, being the lowest point in the treatment bladder, may also act as the liquid purge for the vessel. The TCA fluid coupling may be connected or coupled to the treatment bladder via the bottom or the sidewall, but preferably in a manner such that entirety of the volume of the treatment bladder is fluidly accessible. In instances where the bottom of the treatment bladder is sloped, the TCA fluid coupling may be attached to the treatment bladder at the nadir of the slope, such as shown in FIG. 1C.

The treatment bladder may have a number of associated sensor ports for coupling or connecting sensors such that properties of the treatment and other fluid inside the treatment bladder may be detected, determined, or both. In one or more embodiments, a sensor port is connected to the treatment bladder. In one or more embodiments, a sensor port is coupled to the treatment bladder. In one or more embodiments, a sensor port is coupled to the treatment bladder and positioned along a coupling uptank of an isolation valve. In one or more embodiments, a sensor port is coupled to the treatment bladder and positioned along a coupling downtank of an isolation valve. The treatment bladder may have as many or as few, including none, sensor ports as one of ordinary skill in the art desires for objectives such as, but not limited to, level observation, composition, influx or outflow, other parameter monitoring, automated or manual control of the inhibited water tank and system operations steady state and dynamic conditions, during treatment.

In utilizing the treatment bladder, any change in the fluid communication between the treatment bladder and the TCA would first be noticed at the TCA fluid coupling. Any TCA contamination or heated annular fluid would traverse through this coupling. Contamination fluids would also be noted at the purge/vent fluid coupling as many are less dense than the treatment fluid. Sensors at these two coupling locations may be effective in monitoring the internal condition of the treatment bladder and the progress of treatment. Sensors at the IW fluid coupling may be utilized to compare the properties of introduced fresh inhibited water with the properties of the contents of the treatment bladder detected utilizing other sensors.

For example, the treatment bladder 100 of FIG. 1 shows several sensor ports. A first pair of sensor ports 170A are coupled or connected to the top and bottom of the tank in support of the operation of the optional sight glass 182 (visual inspection window). A second set of sensor ports 170B are coupled or connected uptank of an isolation valve 158 along the TCA fluid coupling 156. A third set of sensor ports 170C are coupled or connected downtank of an isolation valve 158 along the IW pump fluid coupling 154. A fourth set of sensor ports 170D are connected to a sensor port spool 172 coupled downtank from an isolation valve 158 along purge/vent fluid coupling 152. An additional single sensor port 170E is coupled or connected to the top of the tank.

Optionally, the treatment bladder is configured with an aqueous fluid level sensing device. The aqueous fluid level sensing device is configured to detect the liquid level inside the inhibited water bladder that is generally aqueous in nature, that is predominantly the inhibited water, and provide a response associated with the aqueous liquid level. The level sensor is configured to discern between any aqueous and non-aqueous liquids to effectively report the aqueous liquid level in the inhibited water bladder. Aqueous liquids are also typically denser than hydrocarbon liquids. An inhibited water is more conductive than any non-aqueous liquid that may be presented. In some instances, there may be condensable hydrocarbons or other fluids, such as drilling or completion fluids, which may be non-aqueous in nature or have non-aqueous components that may be received during either the cleanup procedure or production startup. For example, in FIG. 1 treatment bladder 100 shows both a level sensor 184 coupled to treatment bladder 100 through sensor port 170E and sight glass 182 coupled through sensor ports 170A. In one or more embodiments, the level sensing device is configured to produce a signal associated with an aqueous liquid level detected within the treatment bladder. As previously stated, a level sensor is not required; however, for utilizing an automated system for conducting either cleanout or startup processes, a level indicator that may produce a data signal reflective of level would likely be utilized. The aqueous fluid sensing device may be commercially available and is not limited in nature other that how described, such as, but not limited to, an electric resistivity or conductivity probe, optical or laser reflectance sensor, a sonic or ultrasonic sensor, or a float having a density attuned to aqueous fluids. A data signal generated by such a level detection device may be manually interpreted or utilized by an automated control system that is in signal communication with a computer processor.

Optionally, the inhibited water bladder is configured with a fluid composition sensing device. The fluid composition sensing device is configured to detect the composition of a fluid and provide a response associated with the composition of the fluid, such as the treatment fluid and potential contaminants entering the treatment bladder. The composition sensor in one or more embodiments is configured to discern between an aqueous fluid and a non-aqueous fluid. Such a composition sensor may be utilized in monitoring the composition of the fluid flowing in and out of the treatment bladder. For example, in FIG. 1, composition sensor 185A coupled to TCA fluid coupling 156 may be utilized to determine an influx of non-aqueous fluids, such as gases or hydrocarbon liquids, or an outflux of inhibited water from the treatment bladder 100. The composition sensor in one or more embodiments is configured to discern between a liquid and a vapor. For example, in FIG. 1, composition sensor 185B coupled to sensor ports spool 172 may be utilized to determine the presence of a gas or liquid accumulation, and in the case of a liquid what type of liquid (aqueous, non-aqueous) in the top-most portion of the inhibited water bladder 100 to report an accumulation of vapor. In one or more embodiments, the fluid composition sensing device is configured to produce a signal associated with the composition detected. As previously stated, a composition sensor is not required; however, for utilizing an automated system for conducting either cleanout or startup processes, a composition indicator that may produce a data signal reflective of detected composition, especially a change in composition, would likely be utilized. A composition sensor may also be utilized after a treatment to ensure that the treatment fluid in the tank is of sufficient quality to be immediately used for a second treatment or if replacement is necessary. The fluid composition sensing device may be commercially available and is not limited in nature other that how described, such as, but not limited to, optical and laser sensors, nuclear sensors, chemical-based sensors, density and viscosity sensors, such as a resonating fork, and nuclear magnetic resonance sensor. A data signal generated by such a fluid composition sensing device may be manually interpreted or utilized by an automated control system that is in signal communication with a computer processor.

One of ordinary skill in the art may recognize that one or more sensors may be useful for monitoring conditions within the treatment bladder as well as to observe changes during treatment. For example, as already described there may be an in-line flow meter 180 on the TCA fluid coupling 156. During treatment when steady-state conditions may be expected, a flow meter should detect no net flow—flow from and to the treatment bladder would either not occur (no gravity/buoyancy-based exchange) or would offset one another (equal amounts going into and out of the treatment bladder). If the flow meter detected an inflow into the treatment bladder, the TCA fluid influx may be due to over pressurization of the TCA or thermal expansion due to exposure to heated production fluid flowing through the production tubing during startup operations. In one or more embodiments, it may be desirable to detect a brief inflow of fluid into the treatment bladder when cleaning the TCA, as will be described further. If the flow meter detects a small yet consistent outflow from the treatment bladder, this may indicate the detection of a leak in a casing or tubing seal associated with the wellbore. If there is no optional monitoring window and the tank is made of an opaque material, a sight glass, such as optional sight glass 182, may be utilized to monitor and determine the fluid level of the treatment bladder for both the type and amount of any material other than treatment fluid and inert gas present in the treatment bladder. With proper training and experience using an optional sight glass, an operator in some instances may be acutely sensitive to the determination of a very small change in fluid level over a given period—much smaller than may be detected by a bulk fluid level gauge. Other examples of potentially useful sensors that may be utilized include, but are not limited to, level indicators, conductivity, density, salinity, optical or electromagnetic reflectance, resistivity, pressure, flow, and temperature. Some of the potentially useful sensors may be configured such that they are similar to water hold-up sensors utilized in horizontal PLT (production while logging), such as the resistivity, optical, and capacitance sensors. In one or more embodiments, the sensor is configured to produce a data signal associated with the detected condition associate with the sensor. The data signal may be manually interpreted or utilized by an automated control system that is in signal communication with a computer processor.

The isolation valves are configured to withstand prolonged exposure to treatment fluid comprising inhibited water, gases, hydrocarbons, and drilling and completion fluids. Such fluids may comprise some of the contaminants in the TCA that are removed by the procedure. The isolation valve associated with the purge/vent fluid coupling may be exposed to hydrocarbon and other non-hydrocarbon gases, such as sour gas (H2S) and acid gases (H2S, CO2). The isolation values are also configured with standard connectors, such as flanges (159) or crow's feet (157), such that they may couple to like connectors on hoses, tubing, or process fluid lines as standard in the industry.

Optionally, the inhibited water bladder is configured with a flow control valve (not shown). In one or more embodiments, the flow control valve is configured to receive a signal associated with a change of position state and operate the valve to affect the position associated with that state, and to produce a signal associated with the position state the control vale is operating. The state of any valve may be "open", "closed", and "partially open", which refers to the ability for a fluid to pass through the value from an upstream side to a downstream side. When in a partially open state and there is a significant pressure difference between the upstream and downstream sides of the value, the flow passing through the control value may be "throttled", that is, restricted in flow such that certain properties, such as pressure and temperature, of the fluid upstream of the valve and downstream of the valve are different. However, this condition is not expected to occur as pressure between the TCA and the treatment bladder should be relatively close if not equilibrized. As one of ordinary skill in the art appreciates, changing the state of a control valve permits selective fluid communication through a flow line. As well, a flow control valve may be manually operated or controlled through an automated control system that is in signal communication with a computer processor.

In one or more embodiments, the bottom of the treatment bladder may be elevated above a surface, such as the surface of the Earth. This may be done for several reasons that involve utilization of the treatment bladder. Elevating the treatment bladder may position the TCA isolation valve higher than an isolation valve on a wellhead for a tubing-casing annulus being treated. Elevating the treatment bladder permits room for the TCA isolation valve to be the bottom-most access port on the treatment bladder by being affixed to the bottom. Such elevation may facilitate full drainage of the treatment bladder to ensure it is clear and empty. Finally, an elevated treatment bladder may be easier to observe during loading and treatment operations. For example, in FIG. 1A several supports 140 are shown coupled or connected to the bottom 130 of treatment bladder 100.

In one or more embodiments, the treatment bladder may be configured for mobile transport. In one or more embodiments, the treatment bladder may be mounted to a frame that permits a lifting device, such as a forklift or a crane, to elevate and move the treatment bladder. "Mounted" in this instance means coupled or connected physically. The treatment bladder is mounted in a position such that the bottom of the treatment bladder is above a bottom-lying surface of what the treatment bladder is mounted to (the bottom of the treatment bladder is not contacting a flat, horizontal surface, for example, the surface of the Earth). In the instance of a forklift transport frame, the frame would be weight-bearing and would be configured such that the tines of the forklift utilized to transport the mounted treatment bladder may not damage an optional sloped bottom or the TCA fluid coupling of the treatment bladder. In one or more embodiments, the treatment bladder may be mounted as part of a mobile, non-self-propelled vehicle, vessel, or platform. For example, a towed barge, a land- or water-borne skiff, or a land- or water-borne drilling platform, "rig", or truck trailer, may be useful to convey the treatment bladder to locations where treatment is to be made. A mobile platform or skiff may have supports that permit it to be lifted and moved by machinery, such as a crane or a boom. In one or more embodiments, the treatment bladder may be mounted onto a mobile self-propelled vehicle, such as a truck, a ship, or an airplane. For example, in FIG. 2, self-propelled vehicle 1002 is shown with a mounted treatment bladder 1100 as part of a treatment fluid distribution system 1000 that is mobile. Mounted treatment bladder 1100 may be similar in features to treatment bladder 100 as shown in FIG. 1A but for being mounted on a flat bed of a truck.

Figure 2:
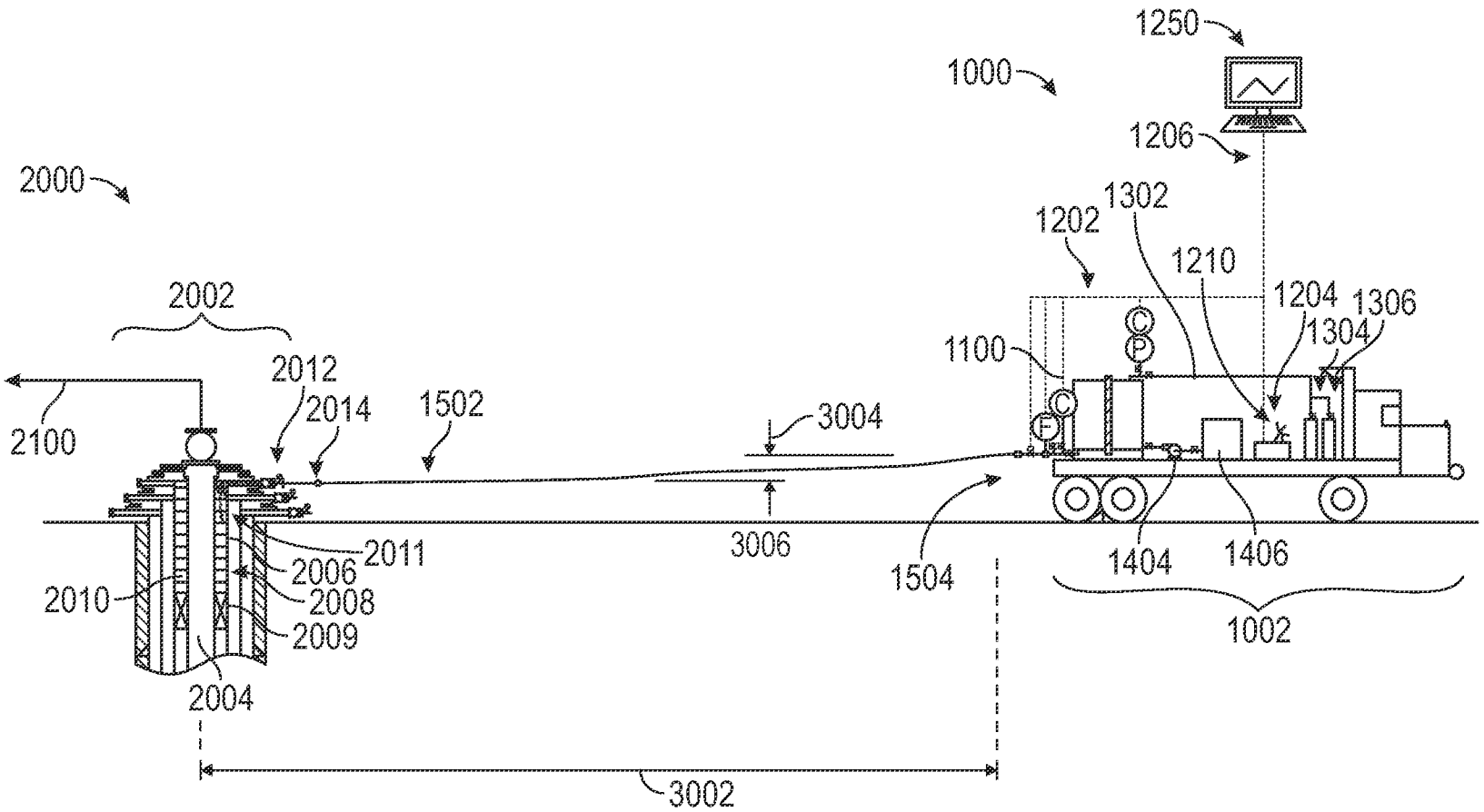
FIG. 2 shows a view of an inhibited water distribution system coupled to a wellhead according to one or more embodiments.

FIG. 2 shows a view of a treatment fluid distribution system coupled to a wellhead. Treatment fluid distribution system 1000 includes treatment bladder 1100 as shown coupled to and in selective fluid communication with several other units and vessels mounted to self-propelled vehicle 1002. Portions of treatment bladder 1100 are in signal communications with a sensor data collection system 1202. For example, at the TCA fluid coupling (not labeled for clarity) there are several sensor signal lines 1204 (dotted) coupling with a flow and a composition sensor (not labeled for clarity). As well, several sensor signal lines 1204 also signally couple a pressure and a composition sensor along the purge/vent fluid coupling (not labeled for clarity). In turn, sensor data collection system 1204 is shown in signal communications through signal line 1206 to computer processor 1250. In one or more embodiments, the computer processor is incorporated with and part of sensor data collection system. Alternatively, any one of the signal communication pathways between any of the sensors, the sensor data collection system, and a computer processor may utilize a wireless communication means, such as shown on sensor data collection system as transmitter/receiver 1210 for local or remote operation, control, or both, of the treatment fluid distribution system.

Treatment bladder 1100 fluidly couples through the purge/vent fluid coupling to purge tank 1302 and inert fluid tank 1304 through a vent line 1306, which includes a three-way valve (not shown) to manage flow. Treatment bladder 1100 may fluidly couple through an IW fluid coupling with IW storage tank 1404, which provides reserve inhibited water and a pressure driver for IW pump 1404.

Treatment fluid distribution system is coupled to and in two-way fluid communication with wellhead system 2000. Treatment bladder 1100 is also coupled to wellhead 2002 through flexible TCA-bladder coupling line 1502. Treatment bladder 1100 is in selective fluid communication with wellhead 2002 utilizing a flow control valve 1504. Flow control valve 1504 is in signal communication with computer processor 1250. In one or more embodiments, the operational state of the flow control valve may be selectively controlled by a computer processor executing a set of pre-fixed instructions that may or may not utilize algorithms for utilizing detected data signals from the one or more sensors associated with the treatment bladder. In other instances, the operational state of the flow control valve may be selectively and manually controlled.

Wellhead 2002 comprises a number of valves and casing heads. In this side view, wellhead 2002 is shown formed from several joined casings and tubing, including production tubing 2004 and production casing 2006. Surface production line 2100 is in fluid communication with production tubing 2004 through wellhead 2002. Tubing-casing annulus 2008 is defined by the exterior surface of the production tubing 2004 and the interior surface of the production casing 2006. Annular packer 2009 is the lower bound of the tubing-casing annulus 2008 to be treated. TCA 2008 is filled with an annular fluid 2010 that in this instance has contamination 2011, for example, light hydrocarbon gases and liquids. The contamination 2011 has risen and accumulated near the top of the TCA 2008. TCA isolation valve 2012 provides selective access to the TCA 2008 at the surface, and contamination 2011 is proximate to the TCA isolation valve 2012. TCA isolation valve 2012 serves as the tubing-casing annulus junction and couples with flexible TCA-bladder coupling line 1502 utilizing an optional transition spool 2014 to prevent direct damage to the wellhead valve that a direct connection may cause.

Treatment fluid distribution system 1000 is shown in FIG. 2 positioned proximate to wellhead system 2000. Mobile treatment fluid distribution system 1000 is positioned just beyond a pre-determined minimum safe distance (3002) from wellhead system 2000, which will vary on circumstances of each project. Minimum safe distance is determined by a number of calculations and determinations made by those of ordinary skill in the art of constructing hydrocarbon production wellheads and bringing hydrocarbon production systems on-line. The treatment bladder 1100 mounted on the back of self-propelled vehicle 1002 is elevated such that the TCA fluid coupling of the treatment bladder 1100 is elevated to a position higher (3004) relative to the TCA connection spool 2014. As shown, the flexible TCA-bladder coupling line 1502 is not perfectly straight, which would represent tension in the coupling, which is not desirable for safety considerations, it also does not "sag" or bend such that a buoyant fluid in the coupling line 1502 would be required to traverse downward in relation to a hypothetical horizontal plane (3006) when flowing from the wellhead to the treatment bladder 1100. Similarly, a neutrally- or non-buoyant fluid in the coupling line 1502 would not be required to traverse upwards in relation to the hypothetical horizontal plane (3006) when flowing from the treatment bladder 1100 to the wellhead 2000. The difference in height between the treatment bladder and the wellhead for positioning the flexible TCA-bladder coupling line facilitates the natural density-driven fluid drive for both the contamination in the TCA to continue to move upward and for treatment fluid in the treatment bladder to move downward in the system, effectively swapping positions over time.

When a mobile vehicle or temporarily installed system is utilized, such vehicle or system may be positioned in a manner that the inhibited water bladder is located at least a minimum safe distance from the wellhead of the wellhead system with the tubing-casing annulus to be treated. This protects not only the system but also the operator, who must at least couple and decouple the system from the wellhead.

In one or more embodiments, the treatment fluid distribution system comprises an treatment bladder along with one or more supporting units. In one or more embodiments, the treatment bladder contains a treatment fluid comprising inhibited water. In one or more embodiments, the treatment bladder contains a treatment fluid comprising nitrogen at an elevated pressure. "Elevated pressure" in this instance means a pressure greater than atmospheric pressure. The treatment bladder is coupled to and in fluid communication with the tubing-casing annulus of the wellbore utilizing a TCA-bladder coupling line. Treatment fluid distribution system is positioned with respect to the tubing-casing annulus such that more buoyant fluids may rise into the treatment bladder and less buoyant fluids may descend into the tubing-casing annulus without any active mechanical assistance when the treatment bladder and the TCA are in fluid communication. That is, the fluid communication between the TCA and the treatment bladder is a passive gravity-driven activity that occurs while the system is maintained.

"Active mechanical assistance" means operating a pump, compressor, or other mechanical means for increasing the pressure of a fluid while the treatment bladder and the tubing-casing annulus are in fluid communication to one another. This definition does not mean that the treatment bladder cannot have its pressure increased or the TCA decreased when the treatment bladder and the tubing-casing annulus are physically coupled or connected to one another, such as through a fluid conduit; however, the treatment bladder and the TCA cannot be in fluid communication during that period as this would communicate the change in pressure condition to the other volume. Rather, fluid flow between the volumes is passive, that is, natural flow produced by gravitational force and density contrast is dominant and preferred to prevent any human error or intervention.

Although shown in FIG. 2 as a flexible and conduit, such as a bendable steel-reinforced coaxial hose, the TCA-bladder coupling line between the treatment bladder and the TCA may be ridged, such as bent tubing or standard piping. As long as the fluid conduit does not have any "dog legs", "goose necks", vapor locks, vacuum locks, or any other curvature or hindrance that prevents fluid flow in either direction. A fluid having a density less than the treatment fluid, like a gaseous or liquid hydrocarbon, will traverse from the TCA to the treatment bladder. A neutral or denser fluid relative to the treatment fluid, such as inhibited water, will traverse from the treatment bladder to the TCA. Any form of coupling may be utilized. The TCA-bladder coupling line is configured to permit two fluids having different densities to flow in opposing directions within the fluid-filled line. The TCA-bladder coupling line has a sufficient pressure rating for the pressure of the fluids in the treatment bladder and the TCA as well for any pressure increase in either vessel due to operational changes, such as initiation of hydrocarbon production.

In one or more embodiments, the sensor data may be converted from an analogue format (originating from the sensor) to a digital format and then transmitted to a remote location for data collection or processing. Such transmitted information may be utilized remotely either manually or by a computer processor to determine the level, contents, or other attributes of the treatment bladder, monitor the system during use, and to communicate instructions to an operator or a control system to take an action regarding the treatment fluid distribution system. Transmission of this may permit centralization and retention of data as well as remote yet active monitoring of activities while minimizing the number of operators proximate to the wellhead.

In one or more embodiments, treatment system may include a computer processor as part of the treatment fluid distribution system to perform certain steps of one or more embodiment processes. For example, the computer processor may utilize a set of pre-determined instructions and algorithms included in memory along with a data signal received from the one or more associated sensors on the treatment bladder to make a determination continuously, periodically, or intermittently, as the condition of the treatment bladder, the fluid level within the treatment bladder and its change over a given period, and the contents of the treatment bladder. In response, the computer processor may utilize pre-set instructions and algorithms to, for example, change the state of the flow control valve, provide estimates for time of completion of the one or more embodiment processes, and send a signal to an output device to alert an operator of a condition. In such embodiments, the computer processor may receive data signals associated with detected conditions, determine an action to take, and transmit a command signal such that at least a part of performing one or more of the steps of one or more embodiment methods occurs, all without human intervention.

Optionally, the sensor data collection system, which is configured to collect and retain sensor data that may be obtained from the treatment bladder either in steady state or during use from one or more of the coupled or connected sensors, may also be configured to transmit information from the mobile treatment fluid distribution system to a remote data collection or processing location. There are many known forms of communications system from local to long-range systems and this is well appreciated in the field of electromagnetic transmission and receipt. Such communications may occur continuously, periodically, or intermittently, such as when passing within operational distance of a trusted wireless communication network. The sensor data collection system may also include an optional output device, such as a video monitor or a printer, which may continuously, periodically, or intermittently display some or all of the information being received and preserved.

The treatment system may include an optional mixing pump. The mixing pump for utilizing liquid treatment fluids may be used in a variety of ways, including, but not limited to, circulating the contents of the treatment bladder in a closed flow loop to maintain consistency of the liquid treatment fluid, to pressurize the treatment bladder by introducing fresh inhibited water or "deadheading" against an otherwise isolated liquid-filled treatment bladder, to pump fresh inhibited water into the lower portion of the treatment bladder when contaminants or compressible inert gases, such as high pressure nitrogen, are present in the upper portion of the treatment bladder to purge them out the purge/vent fluid coupling or to simply refill the treatment bladder. The optional mixing pump is useful in modifying the pressure of the treatment bladder in between uses, where the pressure may be increased from a first service pressure to a second service pressure The system may optionally include an inhibited water storage tank. The optional IW storage tank may be utilized to hold a volume of pre-mixed inhibited water to assist in purging the treatment bladder of contaminants. The IW storage tank may also be involved with circulating the treatment tank using a pump to maintain consistency by introducing inhibited water. In one or more embodiments, the IW storage tank may be accessible such that inhibited water may be fabricated in the tank, such as by adding an appropriate amount of corrosion inhibitor to an appropriate amount of water. Such flexibility may allow a mobile system to be "on the road" or "at sea" for long periods if not permanently.

The system may optionally include a pump or compressor for removing gases and light liquid contaminants from the upper portion of the treatment bladder through the purge/vent fluid coupling. This may be utilized after contaminants from a TCA are removed and present in the treatment bladder. Given that any contaminant that enters the treatment bladder via the TCA fluid coupling should be less dense than the treatment fluid, the contaminants would gradually migrate to an upper portion of the treatment bladder. From there, the contaminants may be extracted and removed, such as into an effluent container, such as purge tank 1302 of FIG. 2, for recovery or research, or injected into the production line, or disposed of in an appropriate and safe manner.

The system may optionally include an inert fluid storage tank that is configured to contain an inert fluid (gas or liquid, such as HP N2) that is pressurized to an elevated pressure. The inert fluid storage may be utilized to pressurize the treatment bladder with a fluid without utilizing a pump or compressor. The inert fluid should be equal to or less dense than the treatment fluid such that it is relatively buoyant. The inert fluid may be introduced at a greater pressure than the treatment fluid in the treatment bladder to pressurize the treatment bladder. In one or more embodiments, the pressurized inert fluid may be the treatment fluid, as will be provided forthcoming.

Although not shown in either FIG. 1 or 2 for the sake of clarity, one of ordinary skill may envision that there may be a system configuration such that a dedicated bleed line fluidly couples an upper vent of the treatment bladder, such as purge/vent fluid coupling 152 of treatment bladder 100 of FIG. 1, to the surface production line 2100 of FIG. 2. Included in such a dedicated bleed line may be apparatus such as a control valve, a check valve, a flow monitoring sensor, and a pump or compressor, so as to ensure one-way fluid communication from the treatment bladder to the surface production line. The bleed line may use active mechanical assistance to ensure that the treatment fluid or contaminants from the treatment bladder are adequately pressurized for introduction into the surface production line.

Figure 3:
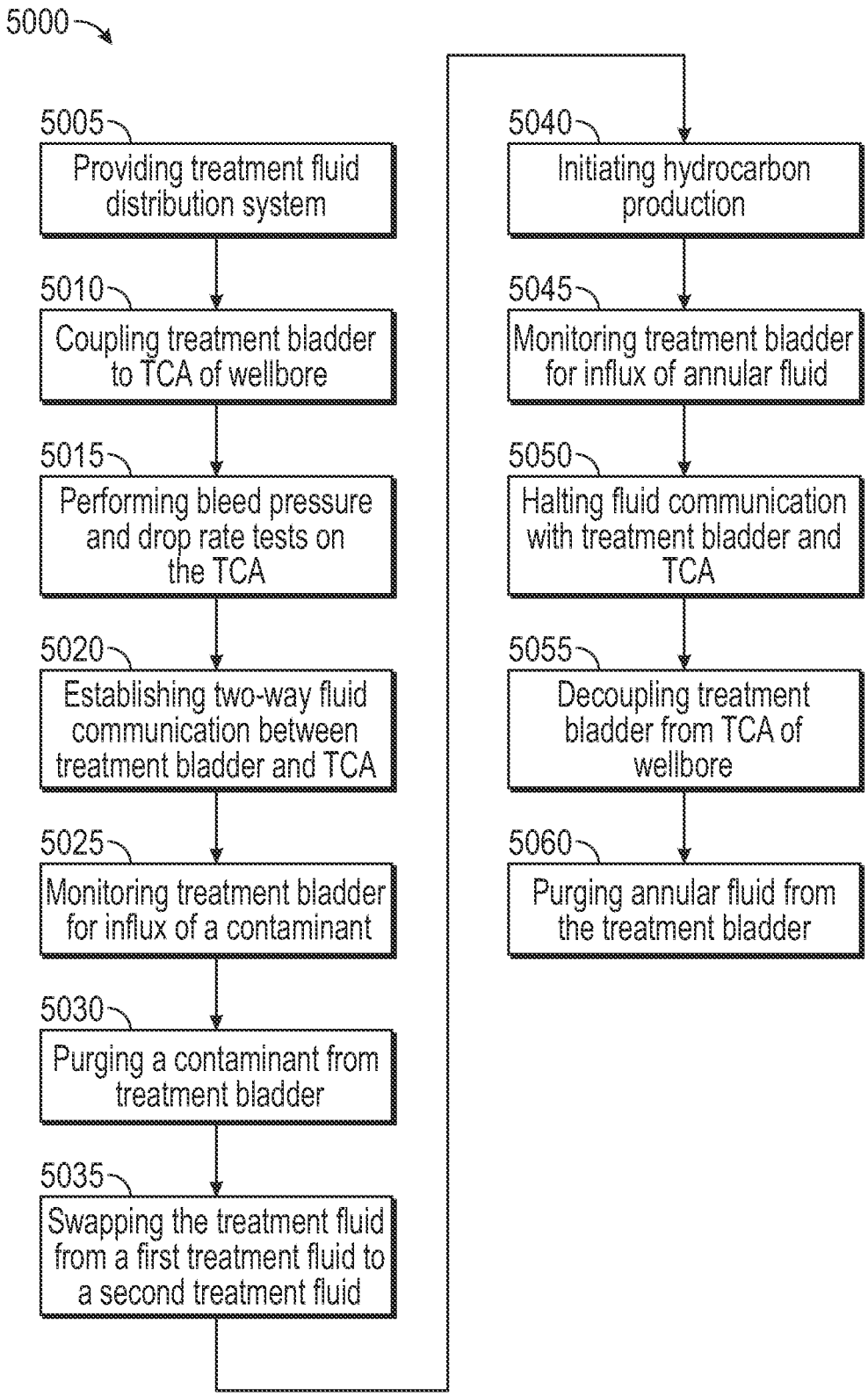
FIG. 3 is a flowchart that illustrates a method of treating a tubing-casing annulus in accordance with one or more embodiments.

FIG. 3 is a flowchart that illustrates a method of treating a tubing-casing annulus. In a method of treating a tubing-casing annulus, a treatment fluid distribution system comprising a treatment bladder with an amount of a first treatment fluid is provided. In method 5000 of FIG. 3, step 5005 shows that a treatment fluid distribution system is provided.

A treatment fluid is provided within the treatment bladder. The treatment fluid is contained in the treatment bladder before initiation of treatment of the tubing-casing annulus of the wellbore. The treatment fluid in one or more embodiments is an inhibited water, which comprises a dissolved corrosion inhibitor in water. The treatment fluid in one or more embodiments is an inert gas, such as nitrogen, at an elevated pressure.

Before utilizing the treatment fluid, the treatment fluid should be inspected to ensure it is appropriate for the treatment to be applied, such as if the well system is to be a natural flowing well or a ESP-supported production well, if the density, composition, pH, and prior amount of contamination is appropriate for potential introduction into the TCA of the wellhead to be treated. One of ordinary skill in the art will appreciate there are a number of case-by-case analysis and decisions that may need to be satisfied before proceeding with eh treatment of any particular TCA.

Optionally, the treatment bladder may contain or have an inert gas introduced into the treatment bladder. In one or more embodiments, an amount of an inert gas may be provided in the treatment fluid. For example, nitrogen may be considered an inert gas for such uses, although any gas that is inert and does not cause corrosion may be utilized in the system. The inert gas may provide several functions. The inert gas may be utilized to act as a physical buffer such that if heated annular fluid expands towards the treatment bladder then the treatment fluid with the inert gas may compress as the pressure increases in the combined TCA/treatment bladder system. The inert gas may act as a diluent at the top of the treatment bladder such that if any contaminants enter that are of the gas phase at surface conditions, such as acid or sour gases, are diluted upon rising to the top of the treatment bladder. If the annular fluid in the TCA has a greater initial pressure upon establishing communications between the two volumes, the inert gas in the treatment bladder allows for the fluid in the treatment bladder to equilibrate before passive fluid transfer occurs. Along that same line, the inert gas may be introduced into the treatment bladder at a greater pressure than an incompressible fluid in the treatment bladder, such as inhibited water, so as to raise the overall pressure of the contents of the treatment bladder without utilizing a pump or compressor. The pressure in the treatment bladder may be such as to avoid dual-phase hydrocarbon formation, that is, maintain the hydrocarbon pressure at less than their bubble point pressure. This may avoid any bubble lock or gas binding in the flow line between the TCA and the treatment bladder. Finally, any contaminant may remain pressurized but buoyant so that it may be captured and sampled in its native form for fluid analysis.

When production is started using a high-flow volume device, such as an electrical submersible pump, the electrical connections in the TCA avoid any sudden change in fluid pressure as the pressure equilibrates across a combined volume that is much larger than merely the TCA.

As previously described in relation to the volume of the treatment bladder to the TCA, the total amount of treatment fluid in the treatment bladder may be in a range of from about 80% to 120% of the volume of the tubing-casing annulus volume to be treated.

The pressure as provided of the treatment bladder in one or more embodiments is in a pressure range of from about atmospheric pressure to 15,000 psi. In one or more embodiments, the pressure value of the treatment bladder is in a range of from about 90 to 110% of the pressure value of the TCA, such as 95 to 105%, such as 95 to 102%, such as 95 to 101%, such as about 95 to 100%, before selectively establishing fluid communication between the two systems.

The pressure difference between the treatment bladder and the TCA should be in a range of equal to or less than 5 psi before initiating fluid communication, where the preference in the difference of the pressure should be greater on the TCA than the treatment bladder. Any over pressurization is minimized to prevent delay and to avoid disrupting the contamination accumulated at the top of the TCA. The treatment bladder may be provided at an elevated pressure by utilizing a pump to elevate the pressure in a liquid-filled treatment bladder; it may be depressurized by letting off pressure from the purge/vent fluid coupling at the top of the bladder. The pressure within the treatment bladder may also be increased by introducing a pressurized inert fluid (gas, liquid) into the interior of the treatment bladder. The treatment fluid in the treatment bladder should not be pressurized over the maximum allowable annular surface pressure (MAASP) of the tubing-casing annulus to be treated as fluid communication of this elevated pressure may damage the TCA.

In one or more embodiments, the pressure in the treatment bladder is less than the pressure in the TCA. By having a reduced pressure of slightly less than the TCA, such as being less than 10%, or less than 5%, or less than 2% of the pressure value of the TCA, permits any contaminants that are present near or at the top of the TCA to be pulled into the coupling line towards the treatment bladder as the pressure equilibrates between the two volumes. This prevents any turbulent back mixing of the contaminants within the annulus. The contaminants, already in the coupling line and more buoyant than the inhibited water, start their traversal to the treatment bladder after pressure equalization. The overall combination of all of these effects is that upon establishing fluid communication between the TCA and the treatment bladder a "low shock" occurs, that is neither fluid is appreciably disturbed upon establishing fluid communication. Not having either fluid significantly disturbed by backflow turbulence facilitates the cleanout process.

In one or more embodiments, a treatment bladder is provided such that the bottom-most portion of the TCA fluid conduit of the treatment bladder is positioned higher than a fluid coupling for selectively accessing a tubing casing annulus for the wellbore to be treated.

In one or more embodiments, the treatment bladder is provided such that the treatment bladder is positioned a distance from the wellbore that is beyond the outside of the pre-determined minimum safe distance from the wellbore to be treated.

In a method for treating a tubing-casing annulus, the treatment bladder couples to a tubing-casing annulus of the wellbore to be treated such that each may be in selective fluid communication with the other. In method 5000 of FIG. 3, step 5010 shows that the treatment bladder is coupled to the tubing casing annulus of the wellbore.

The TCA-bladder coupling line provides a conduit for fluid communication between the treatment bladder to the tubing-casing annulus. The fluid conduit may couple to the treatment bladder at the lower fluid junction and the tubing-casing annulus at a tubing-casing annulus junction. The TCA bladder coupling line is configured such that upon establishing fluid communication the treatment fluid may flow from the treatment bladder to the TCA and any contamination may flow from the TCA to the treatment bladder without any fluid impediment. The treatment fluid and the contamination may flow in opposing directions through the TCA-bladder coupling line simultaneously through the fluid conduit without active mechanical assistance.

In method 5000 of FIG. 3, step 5015 shows that a bleed pressure and drop rate tests may be performed on the TCA before establishing fluid communications between the TCA and the treatment bladder. The treatment bladder is coupled to the tubing casing annulus of the wellbore. In one or more embodiments of the method, a bleed pressure test and a drop rate test may both be performed on the TCA to investigate and ensure seal integrity. An elevated pressure may be applied to the TCA and the pressure monitored for a period to determine if the pressure changes outside of a given testing range during the period. If it does not, then the TCA has integrity and is able to proceed to clean out with reassurance that there are no leaks that communicate through the seals of the TCA. One of ordinary skill in the art of testing well integrity understands and appreciates this part of a procedure.

In a method for treating a tubing-casing annulus, the TCA-bladder coupling line between the treatment bladder and the tubing-casing annulus is selectively opened such that two-way fluid communication is established. In method 5000 of FIG. 3, step 5020 shows that the fluid communication is established between the treatment bladder and the TCA. Initiation of fluid communication may be performed manually, automatically, or through a combination of actions. For example, upon detecting certain pre-determined conditions, a computer processor may send a visual indication to an operator to signal that safety margins and conditions have been satisfied. In response, the operator may then modify the position of a valve, such as an isolation or control valve, to establish two-way fluid communication. In return, the operator may then send a signal (through a button activation) for the computer processor to begin monitoring the system for contamination influx. One of ordinary skill in the art will appreciate many varieties and degrees of interaction or lack thereof are feasible with such a system.

After selectively permitting fluid communication between the treatment bladder and the TCA, pressure equilibrium is established. The pressure modification should be near-instantaneous if the pressure difference between the treatment bladder and the TCA is similar. It is not desirable to have the treatment bladder at a significantly greater pressure than the TCA as such condition may push any contaminants back into the annulus upon establishing fluid communication from a surge of treatment fluid into the TCA. This disturbance would delay the gradual influx of contaminants into the treatment bladder. For example, a fluid flow meter in-line with the TCA fluid conduit may show an initial influx or outflux of fluid from the treatment bladder depending on the pressure differential between the two volumes. In another example, a pressure difference determination between pressure sensors on the TCA and the treatment bladder may slowly descend to approximately 0 as fluid flow into the low-pressure volume from the higher-pressure volume of fluid. After pressure equilibrium is established, fluid flow based upon buoyancy from each vessel should start and should be equal to create a net 0 fluid flow reading and a net 0 pressure differential.

In a method for treating a tubing-casing annulus, the treatment bladder is monitored for any influx of contamination from the TCA. In method 5000 of FIG. 3, step 5025 shows that the treatment bladder is monitored for an influx of contaminants, such as those traversing from the tubing-casing annulus into the treatment bladder.

Depending on the sensor configuration associated with the treatment bladder, an indication of migration of contaminants from the TCA into the treatment bladder may take one or more of observable form for a person, interpretable by a computer processor, or both. Monitoring the treatment fluid distribution system for the influx of contamination may be performed manually, automatically, or a combination thereof. For example, if a viewing window is utilized for visual observation, then gases or a non-aqueous liquid phase may appear at the top of the treatment bladder near the purge/vent fluid conduit. A temperature sensor along the TCA fluid conduit may detect a slight change in fluid temperature as annular fluid, which may be warmer than ambient conditions, enters the treatment bladder. It is noted that the difference in temperature may be very small as the annular fluid will likely be close to ground ambient temperature, which may vary from the temperature of the treatment fluid, as well as heat loss through the fluid conduit. An optical transmittance sensor may detect impurities or density changes in the fluid in the TCA fluid conduit that signals contaminants being introduced into the treatment bladder and transmit a signal associated with such change. A salinity, conductivity, or density sensor may detect a change in a respective reading if the sensor is positioned near the purge/vent fluid conduit as gases and non-aqueous fluids collect near the top of the treatment bladder or in the TCA fluid conduit as fluids pass through it and transmit a signal associated with such change. Other ways of detecting the presence of an influx of annular fluid from the TCA may be utilized by a person of ordinary skill in the art.

The period of monitoring may be as short or as long as a person of ordinary skill in the art determines. In one or more embodiments, the treatment bladder may be monitored for a period in a range of from about 30 minutes to several days. Typically, the process should take no longer than a few hours, but there are factors that may lengthen or shorten the monitoring period, including, but not limited to, the level of contamination in the TCA, the volume of fluid exchanged, the size of the coupling line, the elevation differential, and whether more than one treatment bladder is necessary to fully exchange the volume of the TCA that is contaminated. Contamination entering the treatment bladder may first be noted using sensors configured to monitor composition or fluid flow associated with the TCA fluid coupling or may be done through sight such as fluid level sensors or sight gauges of the treatment bladder. As well, composition sensors associated with the purge/vent fluid coupling may also indicate the entrance of contaminants.

Optionally, the contaminants received from the TCA may be purged from the treatment bladder before continuing the process. In method 5000 of FIG. 3, step 5030 shows that contaminants in the treatment bladder are purged. In one or more embodiments, the contaminants accumulated in the treatment bladder may be purged from the treatment bladder before initiation of hydrocarbon production from the wellhead. Such contaminants may be driven into a collection tank or vessel for study or merely for disposal. For example, contaminants at the top of treatment bladder 1100 may utilize vent line 1302 and pass into purge tank 1304. An inert gas may be utilized to then sweep the upper portion of the treatment bladder, and such sweep gas may then also be routed into purge tank 1304. In other instances, the contaminants accumulated in the treatment bladder may be purged from the treatment bladder using the optional bleed coupled between the treatment bladder and the surface production line, as previously described.

Optionally, when the same treatment system is utilized to both remove contaminants from the TCA as well as to assist in initiating production from the wellbore, the treatment fluid in the treatment bladder may be changed from a first treatment fluid to a second treatment fluid. In method 5000 of FIG. 3, step 5035 shows that the treatment fluid is changed in the treatment bladder from a first treatment fluid to a second treatment fluid (having a different composition). For example, the first treatment fluid may be an inhibited water, and the second treatment fluid may be a nitrogen gas under elevated pressure. Another example may include the first treatment fluid being an inhibited water and the second treatment fluid being a combination of inhibited water with a nitrogen gas under elevated pressure. As well, a first treatment fluid may be nitrogen under elevated pressure and the second treatment fluid may be a combination of inhibited water and nitrogen under elevated pressure. One of ordinary skill in the art of completions and production will appreciate that variations in techniques and compositions may be made given a particular circumstance.

There may be several useful reasons for exchanging the treatment fluid from a first fluid to a second treatment fluid. In production wells that will have ESP-supported production, the increase in temperature on the TCA will be almost immediate. Therefore, cleaning out the TCA as well as providing a buffer for annular fluid expansion may require two different treatment fluids, such as an inhibited water and then either an inhibited water/nitrogen combination to take in the annular fluid expansion. For naturally flowing wells, that is, wells were sufficient reservoir pressure exists to not require ESP support, the same hardware and fluids may be utilized to equilibrate the pressure and control the thermal expansion of annular fluid from the TCA to prevent damage to wellhead sealant or compromise wellhead and wellbore integrity. Since such formations tend to produce at lower flow rates, or may utilize different annular fluids (such as an oil-based fluid), an inert pressurized gas, such as elevated pressure nitrogen, may be sufficient to handle both the removal of contaminants as well as initiation of production. One of ordinary skill in the art may utilize other first or second treatment fluids in hydrocarbon-based TCA cleanout and startup procedures.

In one or more embodiments, after ensuring the TCA is clear of contamination and filled with treatment fluid, hydrocarbon production may be initiated. In a method for treating a tubing-casing annulus, hydrocarbon production is initiated from the wellhead. In method 5000 of FIG. 3, step 5040 shows that crude oil or condensate production is initiated.

As previously described, the initiation of production may take the form of inducing an ESP to begin pumping fluid present in the production tubing towards the surface. In other instances, production may be started by opening a flow valve and permitting the natural pressure differential between the reservoir and the fluid head in the production tubing to allow fluid flow uphole into the surface production line.

In one or more embodiments, a method for initiating production from a wellbore may include establishing fluid communication between the TCA and the treatment fluid distribution system (5020) and then proceed immediately to the initiation of hydrocarbon production (5040).

In one or more embodiments, an inert gas cap may be introduced into the treatment bladder before initiation of hydrocarbon production. Such an inert gas cap, such as pressurized nitrogen, may permit compression of the treatment fluid within the treatment bladder. As the warm production fluid rises to the surface and heats the TCA, thermal expansion of the annular fluid occurs and is introduced towards the treatment bladder. The inert gas should have a sufficient pressure that is greater than the pressure within the treatment bladder, and preferably equal to or greater than the anticipated fluid pressure in the TCA annulus under production conditions. The inert gas cap may permit the treatment bladder and the TCA under production heat to equilibrate at a new, greater pressure than what was present before production was initiated. In such an instance, any fluid contaminants, especially gas contaminants, may still traverse into the treatment bladder and be retained but diluted by the inert gas cap. For example, in FIG. 2 an inert gas from inert gas tank 1306 may be conveyed into treatment bladder 1100 utilizing vent line 1302.

In one or more embodiments, the step of monitoring for an influx of annular fluid is performed. In FIG. 3, method 5000 has the step 5045 of monitoring the treatment bladder for an influx of annular fluid. Any remaining contaminants and expanding heated annular fluid may traverse the coupling line towards the treatment bladder effectively simultaneously. Such monitoring may be conducted manually, through automation, or a combination thereof. Depending on the sensor configuration associated with the treatment bladder, an indication of expanding annular fluid into the treatment bladder may take several forms. An in-line flow meter in the TCA fluid coupling may detect an influx into the treatment bladder of an expanding fluid. If the viewing window is utilized for visual observation, then the gases or non-aqueous liquid phase may change position or be compressed at the top of the treatment bladder near the purge/ vent fluid conduit. A temperature sensor along the TCA fluid conduit may detect a rise in fluid temperature as warmer annular fluid enters the treatment bladder. An optical transmittance sensor may density changes in the fluid in the TCA fluid conduit that signals warmer annular fluid being introduced into the treatment bladder. Other ways of detecting the presence of an influx of annular fluid may be utilized by a person of ordinary skill in the art.

In one or more embodiment methods, fluid communication between the TCA and the treatment bladder is maintained during initiation of hydrocarbon production from the wellhead. As the production fluid flows through the production tubing, the annular fluid in-between the production casing and the production tubing and above the completion packer begins to warm and expand from the heat of the production fluid from the wellbore and the reservoir. By allowing the fluid communication between the TCA and the treatment bladder during this period, the treatment bladder may act to receive the expanding annular fluid and prevent a build-up of fluid pressure in the TCA during the initiation of production. Effectively, the volume affected by the warming annular fluid is effectively doubled: the total fluid volume is a combination of the TCA treated and the treatment bladder volumes.

During this monitoring period, the treatment bladder may also monitored for pressure. Pressure may be monitored utilizing a sensor or gauge near the top of the treatment bladder, such as the purge/vent fluid coupling. Utilizing the treatment bladder, the pressure within the TCA may also be monitored at the safe distance from the wellhead due to the fluid communication in which both vessels share. The pressure detected at the vent/bladder fluid conduit of the treatment bladder may increase as the annular fluid expands with the exposure to heated production fluid and communicates the expanded fluid with the treatment bladder. During this period, the TCA pressure should eventually stabilize at a greater pressure than before the initiation of hydrocarbon production due to the TCA volume being heated by the produced hydrocarbon. If the pressure of the TCA rises to 80% or more of the maximum annular operating pressure (MAOP), then in one or more embodiments hydrocarbon production may be halted and the pressure in the TCA volume bled in an attempt to stabilize the overall TCA/treatment bladder pressure.

An alternative to halting production should the pressure rise to greater than 80% of the MAOP is to utilize a bleed line coupled and in one-way fluid communication between the treatment bladder and the surface production line. In one or more embodiments a bleed line is coupled between the vent/purge coupling and the surface production line. In one or more embodiments, during the monitoring period the optional bleed line coupling the treatment bladder and the surface production line as previously described may be utilized to selectively reduce the TCA pressure. By selectively permitting one-way fluid communication between the treatment bladder and the surface production line, depressurization of the TCA may occur at a safe distance from the wellhead system utilizing the treatment bladder and the bleed line as well as at a safe temperature (as the fluid being depressurized has been through the fluid conduit and the treatment bladder and not directly from the TCA). Such actions may be conducted in some instances automatically, such as by utilizing a pressure sensor on the treatment bladder, a pre-determined set of instructions for the computer processor to execute associated with monitoring, reducing, and stabilizing pressure to a pre-set level, a control valve to permit selective fluid communication through the bleed line, and a pump or compressor to provide active mechanical assistance and to establish one-way fluid flow through the bleed line. Actions may also be taken manually or a combination of automatic and manual actions to alleviate the condition.

The treatment bladder may be monitored for a period in a range of from about 30 minutes to several days. The monitoring may be performed manually, automatically, or a combination thereof. During initial production, one of ordinary skill in the art may find that it is not necessary to intensely monitor the treatment fluid distribution system. There are many factors, including obtaining a steady hydrocarbon production rate, that are not necessarily under the direct operation or control of the treatment fluid distribution system once communication is established. In one or more embodiments, the treatment bladder may be monitored for a period from initiation of the hydrocarbon production until the TCA has a temperature that is about the temperature of the produced hydrocarbon production fluid at the wellhead. Once the temperatures are similar, that is, 10% or less of one another, or 5% or less of one another, 2% or less of one another, or 1% or less of one another, the pressure within the TCA may be considered stabilized and at steady-state.

A method for treating a tubing-casing annulus may include halting fluid communication between the treatment bladder and the tubing-casing annulus. In method 5000 of FIG. 3, step 5050 shows that fluid communication has been selectively halted between the treatment bladder and the tubing casing annulus. In doing so, the TCA is now fluidly isolated. If the fluid isolation occurs after production is established, then the TCA should be at a comparable temperature to the production tubing and at a positive pressure to the pressure of the fluid egressing from the wellbore. Hydrocarbon production may safely continue, and the TCA should remain at a stable and elevated temperature.

After selectively halting the fluid communication between the TCA and the treatment bladder, the fluid coupling itself may be isolated and decoupled from both the tubing-casing annulus junction and the lower fluid junction of the treatment bladder, such as the TCA fluid coupling. In method 5000, step 5055 indicates that decoupling the treatment bladder from the TCA of the wellbore occurs. The TCA-bladder coupling may then be drained of fluid to an appropriate disposal.

In one or more embodiments, the step of initiating hydrocarbon production (5040) and monitoring for influx of annular fluid (5045) are optionally performed. In such instances, an embodiment method may include establishing fluid communication between the TCA and the treatment fluid distribution system, monitoring the treatment fluid distribution system for an influx of contaminants, fluidly isolating the TCA, and then decoupling the treatment bladder from the TCA. No hydrocarbon production need take place after removing contaminants from the TCA. The well may remain shut in and production initiated using a separate procedure at a later time.

Any annular fluid or heated contaminants that may have entered the treatment bladder during startup operations may be purged from the treatment bladder. In method 5000, step 5060 describes purging annular fluid from the treatment bladder. The treatment fluid in the treatment bladder then may be refreshed. In the method for treating a tubing-casing annuls, the contaminants in the treatment bladder may be recovered. In some instances the annular fluid may be in the lower part of the treatment bladder. In other instances, contaminants that were heated during production initiation may reside in the vapor space near the top of the treatment bladder, or may have condensed and are near the lower part of the treatment bladder. In an example, purge tank 1302 from FIG. 2 may be utilized to store any annular fluid or liquid contaminants from the top of the treatment bladder 1100. IW storage 1406 may be utilized to refresh the inhibited water in the treatment bladder 1100.

A process for removing the contaminants from a treatment bladder may include coupling a vent line from the purge/vent fluid coupling of the treatment bladder to the purge tank and establishing one-way fluid communication into the purge tank. The process may also include opening an isolation valve associated with the IW fluid coupling to establish fluid communication between the IW pump and the treatment bladder through the IW fluid coupling. After this fluid circuit is established the IW pump may be turned on to pump inhibited water from the IW tank into the treatment bladder. The fluid flow into the treatment bladder may push out any accumulated contamination out of the treatment bladder via the purge/vent fluid coupling, through the vent line, and into the purge tank. The elimination of the contaminants from the top of the treatment bladder may be confirmed by any sensor associated with the purge/vent fluid coupling. In performing this process, the treatment fluid volume in the treatment bladder is refreshed. The purge tank may then be fluidly isolated and recovered or disposed of accordingly.

Another process for removing the contaminants from the treatment bladder may include coupling a bleed line from the purge/vent fluid coupling of the treatment bladder to the surface production line and establishing one-way fluid communication. The process and system setup have been previously described, and similar arrangements and steps may be made to eliminate contaminants form the treatment bladder to the surface production line. During hydrocarbon production, caution should be utilized to prevent any backflow from the surface production line, that is, the fluid communication is one-way. Sensors, line configuration, and optionally computer processor monitoring may all assist in that endeavor.

Figure 4:
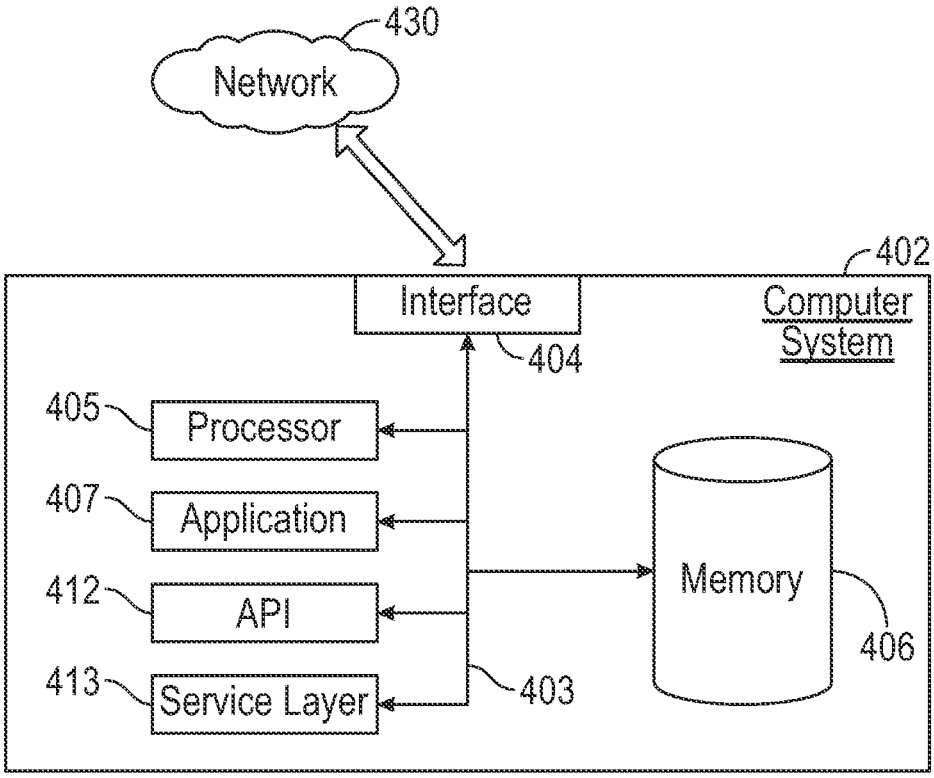
FIG. 4 shows a computer system in accordance with one or more embodiments.

FIG. 4 shows a computer system in accordance with one or more embodiments. FIG. 4 further depicts a block diagram of a computer system (402) used to provide computational functionalities associated with described algorithms, methods, functions, processes, flows, and procedures as described in this disclosure. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer system (402) may include a computer system that includes an input device, such as a keypad, keyboard, touch screen, or other device that can accept user information, and an output device that conveys information associated with the operation of the computer system (402), including digital data, visual, or audio information (or a combination of information), or a graphical user interface (GUI).

The computer system (402) can serve in a role as a client, network component, a server, a database or other persistency, or any other component (or a combination of roles) of a computer system (402) for performing the subject matter described in the instant disclosure. The illustrated computer system (402) is communicably coupled with a network (430). In some implementations, one or more components of the computer system (402) may be configured to operate within environments, including cloud-computing-based, local, global, or other environment (or a combination of environments).

At a high level, the computer system (402) is an electronic computing device operable to receive, transmit, process, store, or manage data and information associated with the described subject matter. According to some implementations, the computer system (402) may also include or be communicably coupled with an application server, e-mail server, web server, caching server, streaming data server, business intelligence (BI) server, or other server (or a combination of servers).

The computer system (402) can receive requests over network (430) from a client application (for example, executing on another computer system (402) and responding to the received requests by processing the said requests in an appropriate software application. In addition, requests may also be sent to the computer system (402) from internal users (for example, from a command console or by other appropriate access method), external or third-parties, other automated applications, as well as any other appropriate entities, individuals, systems, or computers.

Each of the components of the computer system (402) can communicate using a system bus (403). In some implementations, any or all of the components of the computer system (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer system (402) or other components (whether or not illustrated) that are communicably coupled to the computer system (402). The functionality of the computer system (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer system (402), alternative implementations may illustrate the API (412) or the service layer (413) as stand-alone components in relation to other components of the computer system (402) or other components (whether or not illustrated) that are communicably coupled to the computer system (402). Moreover, any or all parts of the API (412) or the service layer (413) may be implemented as child or sub-modules of another software module, enterprise application, or hardware module without departing from the scope of this disclosure.

The computer system (402) includes an interface (404). Although illustrated as a single interface (404) in FIG. 4, two or more interfaces (404) may be used according to particular needs, desires, or particular implementations of the computer system (402). The interface (404) is used by the computer system (402) for communicating with other systems in a distributed environment that are connected to the network (430). Generally, the interface (404) includes logic encoded in software or hardware (or a combination of software and hardware) and operable to communicate with the network (430). More specifically, the interface (404)

may include software supporting one or more communication protocols associated with communications such that the network (430) or interface's hardware is operable to communicate physical signals within and outside of the illustrated computer system (402).

The computer system (402) includes at least one computer processor (405). Although illustrated as a single computer processor (405) in FIG. 4, two or more processors may be used according to particular needs, desires, or particular implementations of the computer system (402). Generally, the computer processor (405) executes instructions and manipulates data to perform the operations of the computer system (402) and any algorithms, methods, functions, processes, flows, and procedures as described in the instant disclosure.

The computer system (402) also includes a memory (406) that holds data for the computer system (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer system (402) and the described functionality. While memory (406) is illustrated as an integral component of the computer system (402), in alternative implementations, memory (406) can be external to the computer system (402).

The application (407) is an algorithmic software engine providing functionality according to particular needs, desires, or particular implementations of the computer system (402), particularly with respect to functionality described in this disclosure. For example, application (407) can serve as one or more components, modules, or applications. Further, although illustrated as a single application (407), the application (407) may be implemented as multiple applications (407) on the computer system (402). In addition, although illustrated as integral to the computer system (402), in alternative implementations, the application (407) can be external to the computer system (402).

There may be any number of computers (402) associated with, or external to, a computer system (402), wherein each computer (402) communicates over network (430). Further, the term "client," "user," and other appropriate terminology may be used interchangeably as appropriate without departing from the scope of this disclosure. Moreover, this disclosure contemplates that many users may use one computer system (402), or that one user may use multiple computer systems (402).

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

When the word "approximately" or "about" are used, this term may mean that there can be a variance in value of up to ±10%, of up to 5%, of up to 2%, of up to 1%, of up to 0.5%, of up to 0.1%, or up to 0.01%.

"Optionally" and all grammatical variations thereof as used refers to a subsequently described event or circumstance that may or may not occur. The description includes instances where the event or circumstance occurs and instances where it does not occur.

The term "substantially" and all grammatical variations thereof as used refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

Thus, particular implementations of the subject matter have been described. Other implementations are within the scope of the following claims.

Although only a few example embodiments have been described in detail, those skilled in the art will readily appreciate that many modifications are possible in the example embodiments without materially departing from the scope of the disclosure. Accordingly, all such modifications are intended to be included within the scope of this disclosure as defined in the following claims. In the claims, means-plus-function clauses are intended to cover the structures described as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims, except for those in which the claim expressly uses the words 'means for' together with an associated function.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open-ended phrase to introduce a recitation of a series of elements, components, materials, or steps should be interpreted to also disclose recitation of the series of elements, components, materials, or steps using the closed terms "consisting of" and "consisting essentially of" For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of" The words "comprise," "has," and "include" and all grammatical variations thereof are each intended to have an open, non-limiting meaning that does not exclude additional elements or steps.

What is claimed is:

1. A treatment system, comprising:

a treatment bladder having a volume, a lower fluid junction, and containing a treatment fluid, where the treatment fluid is at a pressure in a range of from about 90% to 110% of a pressure of a tubing-casing annulus of a wellhead system to be treated, and where the volume is in a range of 80 to 120% of the volume of the tubing-casing annulus to be treated; and a fluid conduit coupled to both the treatment bladder at the lower fluid junction and a tubing-casing annulus junction for a tubing-casing annulus of a wellhead system, where the fluid conduit while coupled is configured to convey a fluid having a density less than the treatment fluid to traverse from the tubing-casing annulus to the treatment bladder and a fluid having a density equal to or greater than the treatment fluid to traverse from the treatment bladder tank to the tubing-casing annulus simultaneously and without any active mechanical assistance when selective fluid connectivity is established between the treatment bladder and the tubing-casing annulus, and where the fluid conduit is rated to withstand both a pressure of at least a maximum allowable annular surface pressure (MAASP) of the tubing-casing annulus and a temperature of at least a maximum production fluid temperature.

2. The treatment system of claim 1, where the treatment fluid is selected from the group consisting of an inhibited water, nitrogen, and combinations thereof.

3. The treatment system of claim 1, where the treatment bladder further comprises a transparent monitoring window.

4. The treatment system of claim 1, where the treatment bladder is transparent.

5. The treatment system of claim 1, where the treatment bladder further comprises a composition sensor positioned proximate to the lower fluid junction.

6. The treatment system of claim 1, where the treatment bladder further comprises a flow sensor positioned proximate to the lower fluid junction.

7. The treatment system of claim 1, where the treatment bladder further comprises an upper fluid junction.

8. The treatment system of claim 7, where the treatment bladder further comprises a composition sensor positioned proximate to the upper fluid junction.

9. The treatment system of claim 7, where the treatment system further comprises a fluid conduit coupled to the upper fluid junction and in one-way fluid communication with a surface production line associated with the wellhead system.

10. The treatment system of claim 1, where the treatment bladder is mounted on a mobile vehicle.

11. The treatment system of claim 1, where the treatment system is in signal communication with a computer processor.

12. A method for treating a tubing-casing annulus, comprising:

coupling using the fluid conduit the treatment bladder containing the treatment fluid of the treatment system of claim 1 to the tubing-casing annulus of the wellhead system, where the lower fluid junction of the treatment bladder is positioned at an elevation higher than the tubing-casing annulus junction of the tubing-casing annulus of the wellhead system;

establishing two-way fluid communication between the tubing-casing annulus using the tubing-casing annulus junction of the wellhead system and the treatment bladder though the fluid conduit;

halting fluid communication though the fluid conduit between the tubing-casing annulus and the treatment bladder; and decoupling the treatment bladder from the tubing-casing annulus.

13. The method of claim 12, further comprising monitoring the treatment bladder for any influx of a contaminant.

14. The method of claim 13, further comprising purging the contaminant from the treatment bladder.

15. The method of claim 12, further comprising initiating hydrocarbon production through the well system.

16. The method of claim 15, further comprising monitoring the treatment bladder for any influx of annular fluid.

17. The method of claim 16, further comprising purging annular fluid from the treatment bladder.

18. The method of claim 12, further comprising changing the treatment fluid in the treatment bladder from a first treatment fluid to a second treatment fluid.

19. The method of claim 18, where the first treatment fluid is an inhibited water and the second treatment fluid is nitrogen at an elevated pressure.

20. The method of claim 12, further comprising coupling the treatment bladder to a surface production line using a bleed line and establishing one-way fluid communication from the treatment bladder to the surface production line.

* * * * *